US010328703B2

(12) United States Patent
Tanaka et al.

(10) Patent No.: US 10,328,703 B2
(45) Date of Patent: Jun. 25, 2019

(54) INKJET RECORDING APPARATUS, INKJET RECORDING METHOD

(71) Applicant: KYOCERA Document Solutions Inc., Osaka-shi, Osaka (JP)

(72) Inventors: Toshihiko Tanaka, Osaka (JP); Toshiaki Mutsuo, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/880,194

(22) Filed: Jan. 25, 2018

(65) Prior Publication Data

US 2018/0236768 A1 Aug. 23, 2018

(30) Foreign Application Priority Data

Feb. 20, 2017 (JP) ..... 2017-028699

(51) Int. Cl.
*B41J 2/165* (2006.01)
*B41J 2/14* (2006.01)
*B41J 2/175* (2006.01)

(52) U.S. Cl.
CPC ..... *B41J 2/165* (2013.01); *B41J 2/14201* (2013.01); *B41J 2/16517* (2013.01); *B41J 2/16579* (2013.01); *B41J 2/16585* (2013.01); *B41J 2/175* (2013.01)

(58) Field of Classification Search
CPC ..... B41J 2/04581; B41J 2/04588; B41J 2/04593; B41J 2/165
See application file for complete search history.

(56) References Cited

U.S. PATENT DOCUMENTS 6,260,959 B1 * 7/2001 Takahashi ..... B41J 2/04581 347/10
2006/0071961 A1 * 4/2006 Tamura ..... B41J 2/04541 347/10
2011/0063351 A1 * 3/2011 Kitaoka ..... B41J 2/04581 347/11
2014/0292873 A1 * 10/2014 Suzuki ..... B41J 2/12 347/15

(Continued)

FOREIGN PATENT DOCUMENTS

JP 2000289229 A 10/2000

*Primary Examiner* — John Zimmermann
(74) *Attorney, Agent, or Firm* — Alleman Hall Creasman & Tuttle LLP

(57) ABSTRACT

An inkjet recording apparatus includes a piezoelectric element, an extraction processing portion, and a drive control portion. The piezoelectric element is provided in correspondence with a nozzle, and upon input of a first drive signal, causes ink to be ejected from the nozzle. The extraction processing portion, when a print process is executed, extracts a non-ejection period during which a non-ejection state continues for more than a reference time period, from an execution period of the print process based on a plurality of pieces of image data printed in the print process, wherein ink is not ejected from the nozzle in the non-ejection state. The drive control portion inputs a second drive signal for causing the piezoelectric element to stir the ink in the nozzle, to the piezoelectric element during a partial period of the non-ejection period extracted by the extraction processing portion.

5 Claims, 5 Drawing Sheets

(56) References Cited

U.S. PATENT DOCUMENTS

| | | | | |
|---|---|---|---|---|
| 2015/0062226 | A1* | 3/2015 | Otokita | B41J 2/0451<br>347/14 |
| 2015/0174899 | A1* | 6/2015 | Otokita | B41J 2/04588<br>347/10 |
| 2015/0367633 | A1* | 12/2015 | Murate | B41J 2/04588<br>347/10 |
| 2016/0271943 | A1* | 9/2016 | Tobita | B41J 2/04581 |

* cited by examiner

FIG.4

X10

| COUNT VALUE | START TIMING |
|---|---|
| 1000～1999 | 100 |
| 2000～2999 | 200 |
| 3000～3999 | 300 |
| 4000～4999 | 400 |
| 5000～5999 | 500 |
| 6000～6999 | 600 |
| 7000～7999 | 700 |
| 8000～8999 | 800 |
| 9000～9999 | 900 |
| 10000～ | 1000 |

INKJET RECORDING APPARATUS, INKJET RECORDING METHOD

INCORPORATION BY REFERENCE

This application is based upon and claims the benefit of priority from the corresponding Japanese Patent Application No. 2017-028699 filed on Feb. 20, 2017, the entire contents of which are incorporated herein by reference.

BACKGROUND

The present disclosure relates to an inkjet recording apparatus and an inkjet recording method.

In an inkjet recording apparatus that forms an image by an inkjet system, ink may be ejected from a nozzle to a sheet when a voltage is applied to a piezoelectric element that corresponds to the nozzle. In addition, in the inkjet recording apparatus, an amount of ink ejected from the nozzle may vary due to increase in viscosity of the ink caused by drying of ink. This reduces the image quality of the print output from the inkjet recording apparatus. With regard to this problem, there is known, as a related technology, an inkjet recording apparatus that ejects ink from the nozzle before the execution of the print process.

SUMMARY

An inkjet recording apparatus according to an aspect of the present disclosure includes a nozzle, a piezoelectric element, an extraction processing portion, and a drive control portion. From the nozzle, ink is ejected. The piezoelectric element is provided in correspondence with the nozzle, and upon input of a predetermined first drive signal, causes the ink to be ejected from the nozzle. The extraction processing portion, when a continuous print process is executed, extracts a non-ejection period during which a non-ejection state continues for more than a predetermined reference time period, from an execution period of the continuous print process based on a plurality of pieces of image data that are printed in the continuous print process, the non-ejection state being a state in which the ink is not ejected from the nozzle. The drive control portion inputs a predetermined second drive signal to the piezoelectric element during a partial or a whole period of the non-ejection period extracted by the extraction processing portion, the second drive signal causing the piezoelectric element to stir the ink in the nozzle and causing the piezoelectric element not to eject the ink from the nozzle.

An inkjet recording method according to another aspect of the present disclosure is executed in an inkjet recording apparatus that includes a nozzle from which ink is ejected, and a piezoelectric element provided in correspondence with the nozzle, and configured to, upon input of a predetermined first drive signal, cause the ink to be ejected from the nozzle. The inkjet recording method includes: when a continuous print process is executed, extracting a non-ejection period during which a non-ejection state continues for more than a predetermined reference time period, from an execution period of the continuous print process based on a plurality of pieces of image data that are printed in the continuous print process, the non-ejection state being a state in which the ink is not ejected from the nozzle; and inputting a predetermined second drive signal to the piezoelectric element during a partial or a whole period of the non-ejection period extracted by the extraction processing portion, the second drive signal causing the piezoelectric element to stir the ink in the nozzle and causing the piezoelectric element not to eject the ink from the nozzle.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

FIG. 4 is a diagram showing an example of table data used in the inkjet recording apparatus according to the embodiment of the present disclosure.

DETAILED DESCRIPTION

The following describes an embodiment of the present disclosure with reference to the accompanying drawings for the understanding of the present disclosure. It should be noted that the following embodiment is an example of a specific embodiment of the present disclosure and should not limit the technical scope of the present disclosure.

[Outlined Configuration of Inkjet Recording Apparatus 10]

Figure 1:
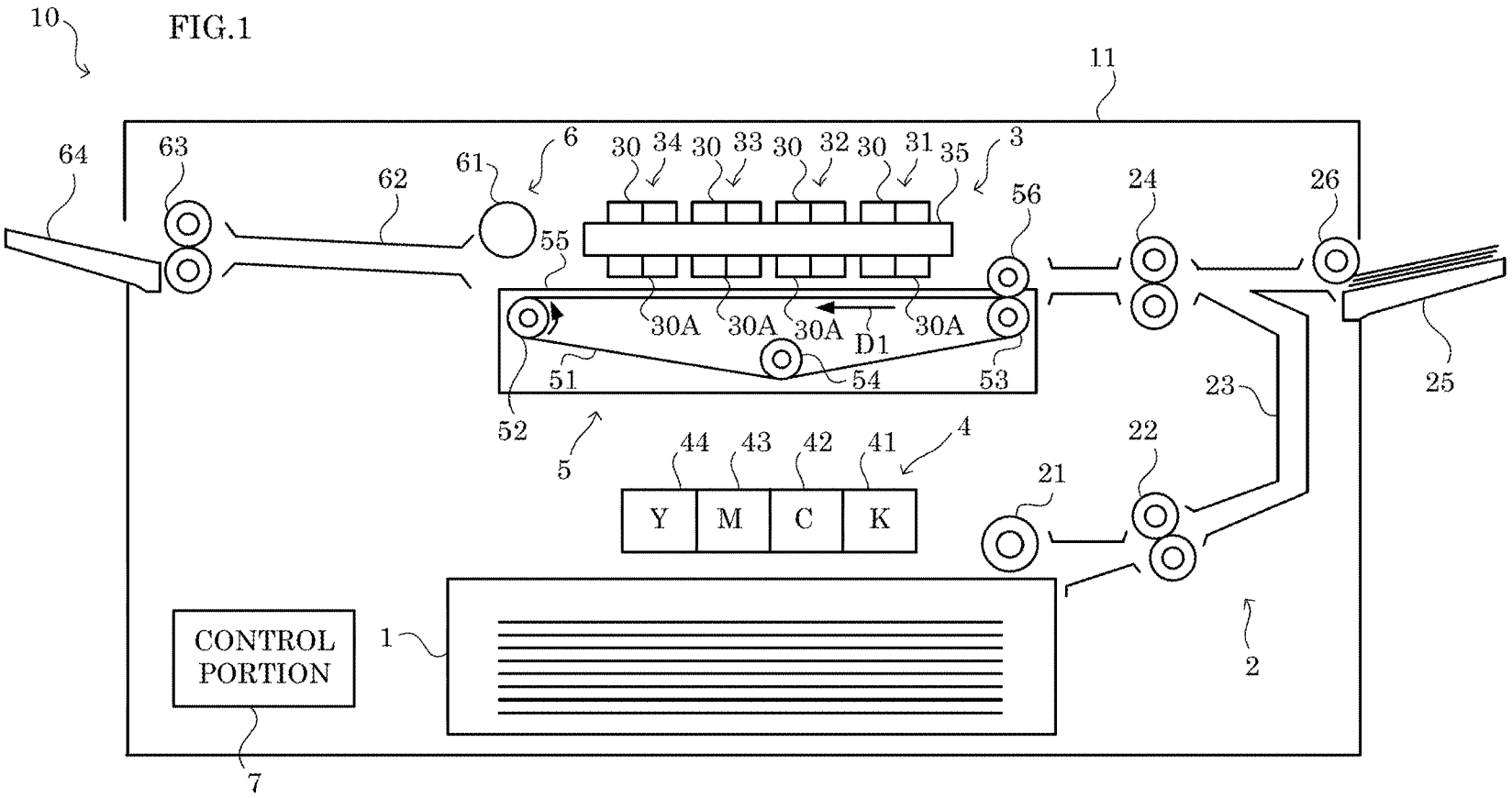
FIG. 1 is a diagram showing a configuration of an inkjet recording apparatus according to an embodiment of the present disclosure.
Figure 2:
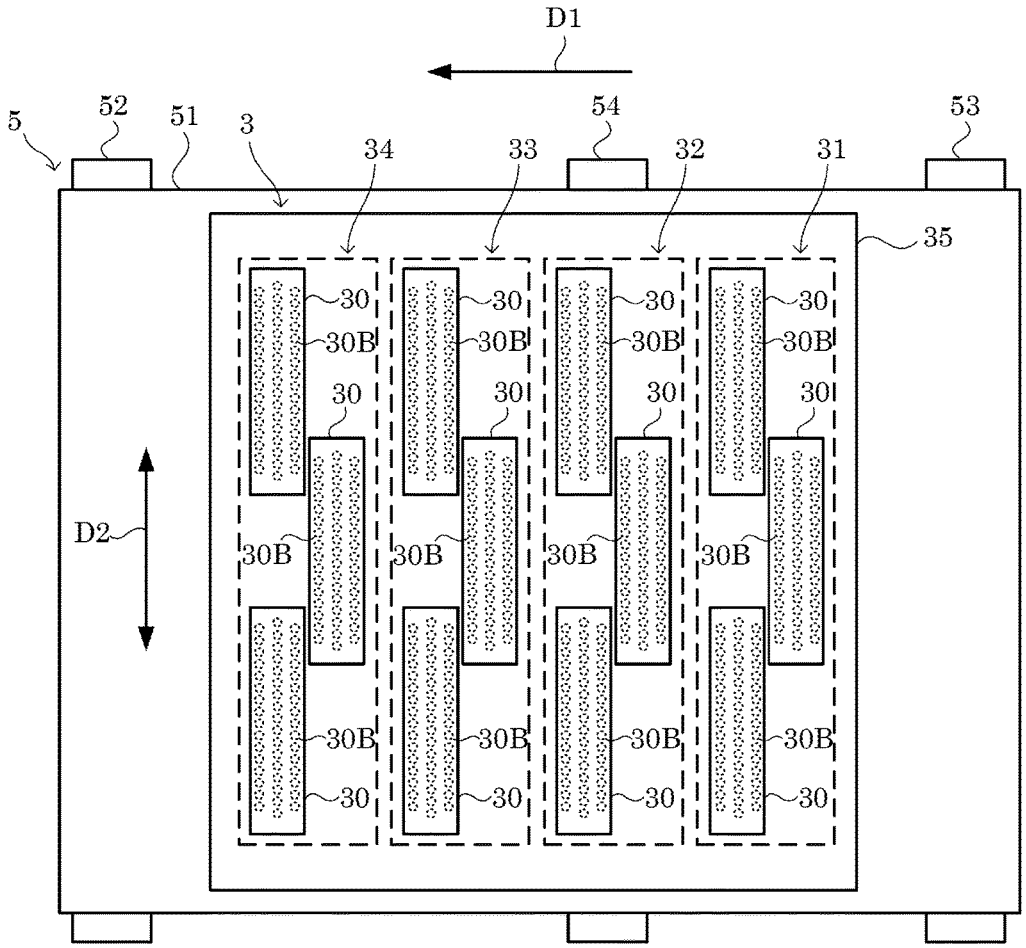
FIG. 2 is a diagram showing a configuration of a recording portion of the inkjet recording apparatus according to the embodiment of the present disclosure.
Figure 3:
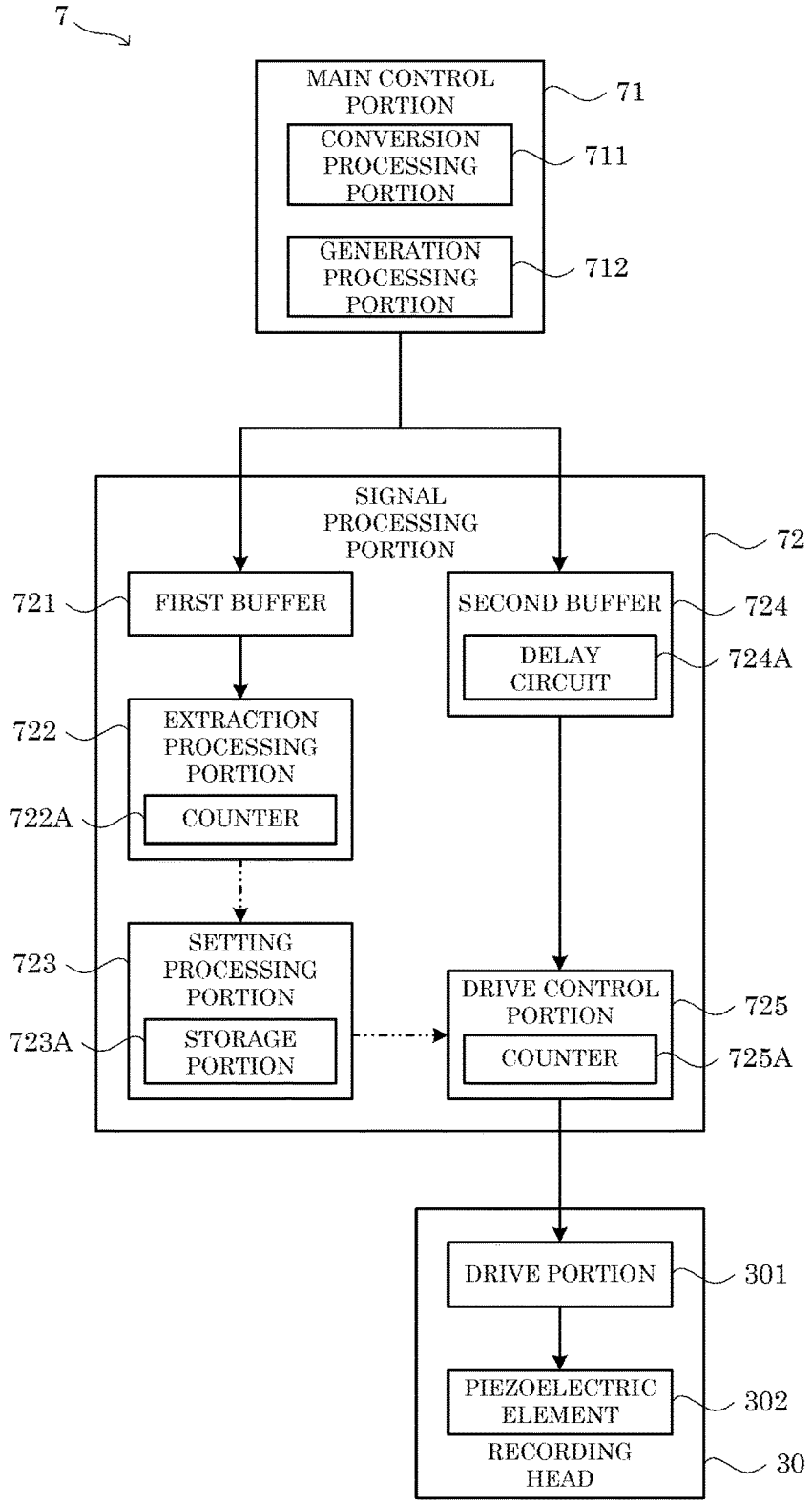
FIG. 3 is a block diagram showing a configuration of a control portion of the inkjet recording apparatus according to the embodiment of the present disclosure.

First, a description is given of an outlined configuration of an inkjet recording apparatus 10 according to an embodiment of the present disclosure, with reference to FIG. 1 to FIG. 3. Here, FIG. 1 is a schematic cross-sectional view showing a configuration of the inkjet recording apparatus 10. FIG. 2 is a plan view showing a configuration of a recording portion 3. It is noted that in FIG. 3, a flow of image data is represented by an arrow line, and a flow of control signal is represented by a two-dot chain line.

The inkjet recording apparatus 10 is a printer that can form an image by an inkjet system. It is noted that the present disclosure is applicable to other types of inkjet recording apparatuses such as a facsimile apparatus, a copier, and a multifunction peripheral.

As shown in FIG. 1, the inkjet recording apparatus 10 includes a sheet feed cassette 1, a sheet feed portion 2, a recording portion 3, an ink container portion 4, a conveyance unit 5, a sheet discharge portion 6, and a control portion 7.

The sheet feed cassette 1 stores sheets that are print targets in the inkjet recording apparatus 10. For example, the sheets stored in the sheet feed cassette 1 are sheet-like materials such as sheets of paper, sheets of coated paper, postcards, envelopes, and OHP sheets.

The sheet feed portion 2 supplies sheets stored in the sheet feed cassette 1 one by one to the recording portion 3. As shown in FIG. 1, the sheet feed portion 2 includes a pickup roller 21, a conveyance roller 22, a conveyance path 23, a registration roller 24, a manual feed tray 25, and a sheet feed roller 26. The pickup roller 21 picks up, one by one, the sheets stored in the sheet feed cassette 1. The conveyance roller 22 conveys the sheet picked up by the pickup roller 21 to the registration roller 24. The conveyance path 23 is a moving passage of the sheet from the sheet feed cassette 1 and the manual feed tray 25 to the recording portion 3. The registration roller 24 conveys the sheet to the recording portion 3 at a predetermined conveyance timing (image writing timing). The manual feed tray 25 and the sheet feed roller 26 are used to supply sheets from outside.

The recording portion 3 records an image on a sheet supplied from the sheet feed portion 2. As shown in FIG. 1, the recording portion 3 includes line heads 31, 32, 33, and 34 and a head frame 35 supporting the line heads, wherein the line heads 31 to 34 respectively correspond to colors of black, cyan, magenta, and yellow. The head frame 35 is supported by a housing 11 of the inkjet recording apparatus 10. It is noted that the number of line heads mounted in the recording portion is not limited to 4 (four), but may be 1 (one) or 2 (two) or more excluding 4.

The line heads 31 to 34 are so-called line-head-type recording heads. That is, the inkjet recording apparatus 10 is a so-called line-head-type inkjet recording apparatus. The line heads 31 to 34 are elongated in a width direction D2 perpendicular to a sheet conveyance direction D1 (see FIG. 2). Specifically, each of the line heads 31 to 34 has a length that corresponds to the width of a sheet of the maximum size among sheets that can be stored in the sheet feed cassette 1. The line heads 31 to 34 are fixed to the head frame 35 at regular intervals along the sheet conveyance direction D1.

As shown in FIG. 2, each of the line heads 31 to 34 includes a plurality of recording heads 30. The recording heads 30 eject ink toward a sheet conveyed by the conveyance unit 5. Specifically, a lot of nozzles 30B for ejection of ink are provided on a facing surface 30A of each of the recording heads 30 (see FIG. 1), each of the nozzles 30B having an opening, the facing surface 30A facing the sheet conveyed by the conveyance unit 5. Each of the recording heads 30 includes pressurizing chambers (not shown), piezoelectric elements 302 (see FIG. 3), and communication flow passages (not shown), the pressurizing chambers respectively corresponding to the nozzles 30B, the piezoelectric elements 302 respectively corresponding to the pressurizing chambers, the communication flow passages being respectively communicated with the pressurizing chambers. Upon input of a predetermined first drive signal, each of the piezoelectric elements 302 causes ink to be ejected from the nozzle 30B. For example, the first drive signal is a clock signal having predetermined voltage, frequency, and duty ratio. Specifically, each of the piezoelectric elements 302 pressurizes ink stored in the pressurizing chamber so that the ink is ejected from the nozzle 30B.

As shown in FIG. 3, each of the recording heads 30 includes a drive portion 301. The drive portions 301 are provided respectively in correspondence with the piezoelectric elements 302. The drive portion 301 generates a drive signal for driving the piezoelectric element 302, based on image data input from the control portion 7, and inputs the generated drive signal to the piezoelectric element 302.

In the present embodiment, three recording heads 30 are arranged in zigzag along the width direction D2. In addition, in each of the other line heads 32 to 34, as in the line head 31, three recording heads 30 are arranged in zigzag along the width direction D2. It is noted that FIG. 2 shows a state where the recording portion 3 is viewed from the upper side of FIG. 1.

The ink container portion 4 includes ink containers 41, 42, 43, and 44 that respectively store black, cyan, magenta, and yellow ink. The ink containers 41, 42, 43, and 44 are respectively connected to the line heads 31 to 34 of the same color, via an ink supply portion (not shown).

The conveyance unit 5 is disposed below the line heads 31 to 34. The conveyance unit 5 conveys the sheet in such a state where the sheet faces the facing surfaces 30A of the recording heads 30. As shown in FIG. 1, the conveyance unit 5 includes a sheet conveyance belt 51 on which the sheet is placed, stretching rollers 52 to 54, and a conveyance frame 55, the sheet conveying belt 51 being stretched over the stretching rollers 52 to 54, the conveyance frame 55 supporting these members. It is noted that the interval between the sheet conveyance belt 51 and the facing surfaces 30A is adjusted so that during an image recording, the interval between the sheet and the facing surfaces 30A becomes, for example, 1 (one) mm.

The stretching roller 52 is coupled with a rotation shaft of a motor (not shown). When the motor is driven and the stretching roller 52 is rotated counterclockwise, the sheet conveyance belt 51 moves rotationally so as to convey the sheet in the conveyance direction D1. As the sheet conveyance belt 51 moves rotationally in such a manner, the sheet supplied from the sheet feed portion 2 is conveyed through the recording portion 3 toward the sheet discharge portion 6. It is noted that the conveyance unit 5 also includes a suction unit (not shown) for sucking air through a lot of through holes formed in the sheet conveyance belt 51 so that the sheet is attracted by the sheet conveyance belt 51. In addition, a pressure roller 56 is provided positioned to face the stretching roller 53 so as to press the conveyed sheet against the sheet conveyance belt 51.

The sheet discharge portion 6 is provided downstream of the recording portion 3 in the conveyance direction D1. As shown in FIG. 1, the sheet discharge portion 6 includes a drying device 61, a conveyance path 62, a sheet discharge roller 63, and a sheet discharge tray 64. The drying device 61 dries the ink that has been fixed to the sheet, by, for example, blowing air to the sheet. The sheet dried by the drying device 61 is fed to the conveyance path 62, and is discharged onto the sheet discharge tray 64 by the sheet discharge roller 63.

Meanwhile, in the inkjet recording apparatus 10, an amount of ink ejected from the nozzle 30B may vary due to increase in viscosity of the ink caused by drying of ink. This reduces the image quality of the print output from the inkjet recording apparatus 10. With regard to this problem, there is known an inkjet recording apparatus that ejects ink from the nozzles 30B before the execution of the print process.

However, even during the execution of the print process, the ink may be dried and the amount of ink ejected from the nozzle 30B may vary if a non-ejection state continues, the non-ejection state being a state where the ink is not ejected from the nozzle 30B. On the other hand, as described below, the inkjet recording apparatus 10 according to the embodiment of the present disclosure can improve the image quality of the print.

In the following, the control portion 7 is described with reference to FIG. 3. As shown in FIG. 3, the control portion 7 includes a main control portion 71 and a plurality of signal processing portions 72. The signal processing portions 72 are provided to correspond to the piezoelectric elements 302 that correspond to the nozzles 30B.

The main control portion 71 comprehensively controls the inkjet recording apparatus 10. Specifically, the main control portion 71 includes control equipment such as CPU, ROM, and RAM that are not shown. The CPU is a processor that executes various calculation processes. The ROM is a non-volatile storage device in which various information such as control programs for causing the CPU to execute various processes are stored in advance. The RAM is a volatile storage device that is used as a temporary storage memory (working area) for the various processes executed by the CPU. In the main control portion 71, the CPU executes the various control programs stored in advance in the ROM. This allows the inkjet recording apparatus 10 to be controlled comprehensively by the main control portion 71.

As shown in FIG. 3, the main control portion 71 includes a conversion processing portion 711 and a generation processing portion 712. Specifically, the main control portion 71 functions as the conversion processing portion 711 and the generation processing portion 712 when it executes the control programs stored in the ROM.

The conversion processing portion 711 converts each of a plurality of pieces of pixel data included in the image data that is printed by the inkjet recording apparatus 10, to either ejection pixel data or non-ejection pixel data, wherein the ejection pixel data corresponds to ejection of ink from a nozzle 30B that corresponds to a position of the piece of pixel data in the image data in the main scanning direction, and the non-ejection pixel data corresponds to non-ejection of ink from the nozzle 30B that corresponds to the position of the piece of pixel data in the image data in the main scanning direction.

Here, the ejection pixel data corresponds to the first drive signal that causes the piezoelectric element 302 to eject the ink from the nozzle 30B. In addition, the non-ejection pixel data corresponds to the third drive signal that does not cause the piezoelectric element 302 to eject the ink from the nozzle 30B.

The generation processing portion 712, when a continuous print process of sequentially printing a plurality of pieces of image data is executed, generates print data in which the plurality of pieces of image data printed in the continuous print process are aligned in order of printing via one or more pieces of inter-paper data that correspond to intervals between the plurality of pieces of image data.

Specifically, the generation processing portion 712 generates print data in which a plurality of pieces of image data converted by the conversion processing portion 711 are aligned in order of printing via one or more pieces of inter-paper data. Here, the inter-paper data is composed of the non-ejection pixel data. It is noted that the inter-paper data may include: data that is added to upstream, in a sub scanning direction, of a piece of image data that is printed first in the continuous print process; and data that is added to downstream, in the sub scanning direction, of a piece of image data that is printed last in the continuous print process.

The generation processing portion 712 outputs each piece of pixel data included in the generated print data, to a signal processing portion 72 that corresponds to a position of the piece of pixel data in the print data in the main scanning direction. Specifically, the generation processing portion 712 outputs each piece of pixel data in the print data in order from the upstream to the downstream in the sub scanning direction.

In addition, when a single print process of printing a piece of image data is executed, the generation processing portion 712 regards a piece of image data converted by the conversion processing portion 711 as the print data, and outputs each piece of pixel data included in the print data, to a signal processing portion 72 that corresponds to a position of the piece of pixel data in the print data in the main scanning direction.

The signal processing portion 72 controls driving of the piezoelectric element 302 based on the pixel data input from the generation processing portion 712. In addition, the signal processing portion 72 causes the piezoelectric element 302 to execute a flashing during a partial period of a non-ejection period during which a non-ejection state continues for more than a predetermined reference time period, the non-ejection period being extracted from the execution period of the continuous print process or the single print process, the flashing causing the ink in the nozzle 30B to be stirred, the non-ejection state being a state in which the ink is not ejected from the nozzle 30B.

Specifically, each of the signal processing portions 72 is composed of an electronic circuit such as an integrated circuit (ASIC, DSP). As shown in FIG. 3, each of the signal processing portions 72 includes a first buffer 721, an extraction processing portion 722, a setting processing portion 723, a second buffer 724, and a drive control portion 725. In the signal processing portion 72, the pixel data output from the generation processing portion 712 is input to both the first buffer 721 and the second buffer 724.

The first buffer 721 outputs each piece of pixel data included in the print data input from the generation processing portion 712, to the extraction processing portion 722. Specifically, the first buffer 721 outputs each piece of pixel data included in the print data, in order from the upstream in the sub scanning direction at predetermined intervals. Here, the predetermined interval is a driving interval in the drive portion 301, and is a time period required for the conveyance unit 5 to convey the sheet such that an ink ejection position (a pixel recording position), namely a position on the sheet at which the nozzle 30B ejects the ink, moves toward the downstream in the sub scanning direction by one pixel.

The second buffer 724 outputs each piece of pixel data included in the print data input from the generation processing portion 712, to the drive control portion 725. Specifically, the second buffer 724 outputs each piece of pixel data included in the print data, in order from the upstream in the sub scanning direction at the predetermined intervals. In addition, the second buffer 724 delays the output of each piece of pixel data included in the print data to the drive control portion 725, by a predetermined delay time compared to the first buffer 721.

For example, as shown in FIG. 3, the second buffer 724 includes a delay circuit 724A. The delay circuit 724A outputs each piece of pixel data to the drive control portion 725 after an elapse of a time (the delay time) that is obtained by multiplying the predetermined interval by a specific number. That is, the delay circuit 724A delays the output of the pixel data by the number of pixels that corresponds to the specific number. For example, the specific number may be 1000. In that case, in the signal processing portion 72, the first piece of pixel data is input from the delay circuit 724A to the drive control portion 725 at a timing when the $1001^{st}$ piece of pixel data is input from the first buffer 721 to the extraction processing portion 722. It is noted that the specific number may be an arbitrary number other than 1000.

When the continuous print process is executed, the extraction processing portion 722 extracts the non-ejection period from the execution period of the continuous print process, based on a plurality of pieces of image data that are printed in the continuous print process.

In addition, when the single print process is executed, the extraction processing portion 722 extracts the non-ejection period from the execution period of the single print process, based on a piece of image data that is printed in the single print process.

Specifically, the extraction processing portion 722 extracts, as the non-ejection period, a period during which a non-ejection pixel sequence is output, wherein the non-ejection pixel sequence is composed of non-ejection pixels that continue in the print data exceeding a reference number that corresponds to the reference time period, the non-ejection pixels corresponding to non-ejection of the ink in the print data. For example, the reference number may be 999. In that case, the reference time period is obtained by multiplying the predetermined interval by 999. It is noted that the reference number may be an arbitrary number other than 999.

More specifically, the extraction processing portion 722 counts the continuous inputs of non-ejection pixels from the first buffer 721, and determines whether or not a continuous set of non-ejection pixels is a non-ejection pixel sequence, based on a result of counting the continuous inputs of non-ejection pixels at a time when an ejection pixel is input from the first buffer 721, wherein the ejection pixel corresponds to an ejection of the ink. That is, the extraction processing portion 722 determines that a continuous set of non-ejection pixels is a non-ejection pixel sequence in a case where the result of counting the continuous inputs of non-ejection pixels exceeds the reference number at the time when an ejection pixel is input from the first buffer 721.

For example, as shown in FIG. 3, the extraction processing portion 722 includes a counter 722A. The counter 722A counts the continuous inputs of non-ejection pixels from the first buffer 721. Specifically, each time a piece of pixel data is input from the first buffer 721, the counter 722A determines whether or not the input piece of pixel data is a piece of non-ejection pixel data. Upon determining that a piece of pixel data input from the first buffer 721 is a piece of non-ejection pixel data, the counter 722A increments the count value. In addition, upon determining that a piece of pixel data input from the first buffer 721 is a piece of ejection pixel data, the counter 722A notifies the extraction processing portion 722 of the count value at that time, and resets the count value to 0 (zero). It is noted that the extraction processing portion 722 resets the count value of the counter 722A to 0 before the continuous print process or the single print process is executed.

Upon receiving the notification of the count value from the counter 722A, the extraction processing portion 722 determines whether or not the notified count value exceeds the reference number. In a case where the notified count value exceeds the reference number, the extraction processing portion 722 determines that the continuous set of non-ejection pixels is a non-ejection pixel sequence, and notifies the setting processing portion 723 of the notified count value. In addition, in a case where the notified count value is equal to or less than the reference number, the extraction processing portion 722 determines that the continuous set of non-ejection pixels is not a non-ejection pixel sequence.

That is, in the inkjet recording apparatus 10, the following period is extracted as the non-ejection period: a period from a timing at which the piezoelectric element 302 is driven based on a piece of pixel data that is input when the counter 722A starts to be incremented, to a timing at which the piezoelectric element 302 is driven based on a piece of pixel data that is input when the count value of the counter 722A is reset after the count value exceeds the reference number.

It is noted that the extraction processing portion 722 may measure the time during which non-ejection pixels are continuously input from the first buffer 721, instead of counting the continuous inputs of non-ejection pixels from the first buffer 721.

The setting processing portion 723 sets a start timing at which to start the flashing in the non-ejection period, based on the length of the non-ejection period. Specifically, the setting processing portion 723 sets the start timing based on the number of continuous inputs of non-ejection pixels counted by the extraction processing portion 722 in a case where the extraction processing portion 722 determines that the continuous set of non-ejection pixels is a non-ejection pixel sequence.

For example, as shown in FIG. 3, the setting processing portion 723 includes a storage portion 723A. The storage portion 723A stores table data X10 in which various lengths of the non-ejection period (the count value of the counter 722A notified from the extraction processing portion 722) are associated with start timings. FIG. 4 shows an example of the table data X10.

Upon receiving a notification of the count value of the counter 722A from the extraction processing portion 722, the setting processing portion 723 obtains a start timing based on the notified count value and the table data X10. Subsequently, the setting processing portion 723 sets the start timing by notifying the drive control portion 725 of the obtained start timing.

It is noted that the signal processing portion 72 may not include the setting processing portion 723.

The drive control portion 725 inputs a predetermined second drive signal to the piezoelectric element 302 during a partial period of the non-ejection period extracted by the extraction processing portion 722, wherein the second drive signal causes the piezoelectric element 302 to stir the ink in the nozzle 30B and causes the piezoelectric elements 302 not to eject the ink from the nozzle 30B.

Specifically, the drive control portion 725 inputs the second drive signal to the piezoelectric element 302 during a period in the non-ejection period from the start timing set by the setting processing portion 723 to the end of the non-ejection period. It is noted that in a case where the signal processing portion 72 does not include the setting processing portion 723, the drive control portion 725 may input the second drive signal to the piezoelectric element 302 during a period from a predetermined start timing to the end of the non-ejection period.

In addition, the drive control portion 725 replaces each piece of non-ejection pixel data, included in the non-ejection pixel sequence, that corresponds to a period from the start timing set by the setting processing portion 723 to the end of the non-ejection period, with specific pixel data that corresponds to the second drive signal. Specifically, the drive control portion 725 replaces each piece of pixel data that is input from the second buffer 724 during the period from the start timing set by the setting processing portion 723 to an input of a piece of ejection pixel data, with the specific pixel data. Subsequently, the drive control portion 725 inputs the second drive signal to the piezoelectric element 302 by inputting the specific pixel data to the drive portion 301.

For example, as shown in FIG. 3, the drive control portion 725 includes a counter 725A. When the start timing is set by the setting processing portion 723, the counter 725A counts the remaining number of pixels until a piece of ejection pixel data is input from the second buffer 724. In other words, the counter 725A counts the number of pixels that corresponds to the remaining time until the end of the non-ejection period. Specifically, when the start timing is set by the setting processing portion 723, the counter 725A sets the count value to the specific value (1000). Subsequently, the counter 725A decrements the count value each time a piece of pixel data is input from the second buffer 724.

For example, before the start timing is set by the setting processing portion 723, the drive control portion 725 holds the pixel data input from the delay circuit 724A, for a time period that corresponds to the predetermined interval, and then outputs the pixel data to the drive portion 301 of the recording head 30. It is noted that in the inkjet recording apparatus 10, the start timing is set on the condition that the number of continuous pieces of non-ejection pixel data exceeds the number of pixels (1000) delayed by the delay circuit 724A. As a result, in the inkjet recording apparatus 10, output of pixel data from the delay circuit 724A is started before the setting processing portion 723 sets the start timing.

In addition, after the setting processing portion 723 sets the start timing, the drive control portion 725 determines, based on the count value of the counter 725A, whether or not the start timing has come. Specifically, the drive control portion 725 determines that the start timing has come in a case where the count value of the counter 725A is equal to or less than the value of the start timing set by the setting processing portion 723.

Here, upon determining that the start timing has come, the drive control portion 725 replaces the pixel data held therein to the specific pixel data, and outputs the specific pixel data to the drive portion 301 of the recording head 30. On the other hand, upon determining that the start timing has not come, the drive control portion 725 outputs the pixel data held therein to the drive portion 301 of the recording head 30 as it is. The drive control portion 725 determines whether or not the start timing has come, each time a piece of pixel data is input from the second buffer 724 and the count value of the counter 725A is decremented. In addition, when the count value of the counter 725A has become 0 (zero), the drive control portion 725 outputs the pixels data input from the second buffer 724, to the drive portion 301 of the recording head 30 as it is, during a period until the start timing is set by the setting processing portion 723.

The drive portion 301 drives the piezoelectric element 302 based on pixel data that has been subject to a replacement process performed by the drive control portion 725. That is, when a piece of pixel data input from the drive control portion 725 is a piece of ejection pixel data, the drive portion 301 inputs the first drive signal to the piezoelectric element 302. In addition, when a piece of pixel data input from the drive control portion 725 is the specific pixel data, the drive portion 301 inputs the second drive signal to the piezoelectric element 302. Furthermore, when a piece of pixel data input from the drive control portion 725 is a piece of non-ejection pixel data, the drive portion 301 inputs the third drive signal to the piezoelectric element 302.

With the above-described operation, a piece of image data or a plurality of pieces of image data included in the print data are printed. In addition, the non-ejection period during which the non-ejection state continues for more than the reference time period is extracted from the execution period of the print process (the continuous print process or the single print process), and the flashing is performed to stir the ink in the nozzle 30B during a partial period of the extracted non-ejection period, wherein the non-ejection state is a state in which the ink is not ejected from the nozzle 30B.

Figure 5:
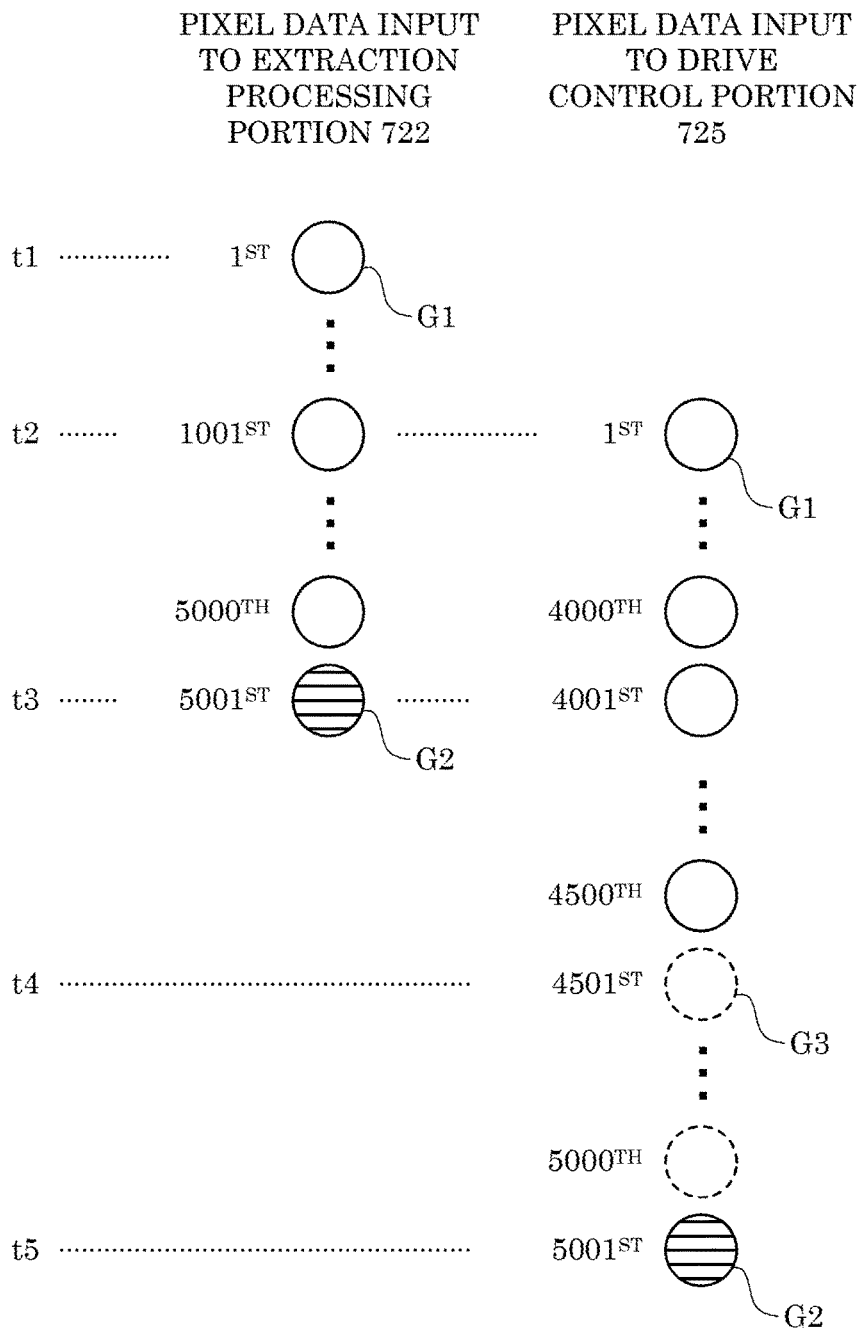
FIG. 5 is a diagram for explaining content of processing performed by a signal processing portion of the inkjet recording apparatus according to the embodiment of the present disclosure.

The following describes the content of processing performed by the signal processing portion 72 with reference to FIG. 5. It is noted that in FIG. 5, all pieces of pixel data from the first piece to the $5000^{th}$ piece of pixel data input to the extraction processing portion 722 are non-ejection pixel data G1. In addition, the $5001^{st}$ piece of pixel data input to the extraction processing portion 722 is ejection pixel data G2.

First, at timing t1, the first piece of pixel data is input from the first buffer 721 to the extraction processing portion 722. The counter 722A of the extraction processing portion 722 determines whether or not the input piece of pixel data is non-ejection pixel data. The pixel data input to the extraction processing portion 722 at timing t1 is non-ejection pixel data G1. As a result, the counter 722A increments the count value. Consequently, the count value of the counter 722A becomes 1 (one).

On the other hand, at timing t1, no piece of pixel data is input from the second buffer 724 to the drive control portion 725.

Next, at at timing t2, the $1001^{st}$ piece of pixel data is input from the first buffer 721 to the extraction processing portion 722. The counter 722A determines whether or not the input piece of pixel data is non-ejection pixel data. The pixel data input to the extraction processing portion 722 at timing t2 is non-ejection pixel data G1. As a result, the counter 722A increments the count value. Consequently, the count value of the counter 722A becomes 1001.

On the other hand, at timing t2, the first piece of pixel data is input from the second buffer 724 to the drive control portion 725. At timing t2, the setting processing portion 723 has not set the start timing yet. As a result, the drive control portion 725 holds the first piece of pixel data for a time period that corresponds to the predetermined interval, and then outputs the pixel data to the drive portion 301 of the recording head 30.

Subsequently, at timing t3, the $5001^{st}$ piece of pixel data is input from the first buffer 721 to the extraction processing portion 722. The counter 722A determines whether or not the input piece of pixel data is non-ejection pixel data. The pixel data input to the extraction processing portion 722 at timing t3 is ejection pixel data G2. As a result, the counter 722A notifies the extraction processing portion 722 of the count value at that time, and resets the count value to 0 (zero). The extraction processing portion 722 determines whether or not the count value notified from the counter 722A exceeds the reference number (999). The count value of the counter 722A at timing t3 is 5000. As a result, the extraction processing portion 722 notifies the setting processing portion 723 of the count value notified from the counter 722A.

Upon receiving a notification of the count value of the counter 722A from the extraction processing portion 722 at timing t3, the setting processing portion 723 obtains the start timing based on the notified count value and the table data X10. Here, the start timing corresponding to the count value 5000 is 500 (see FIG. 4). As a result, at timing t3, the setting processing portion 723 sets the start timing by notifying the drive control portion 725 of the obtained start timing. The counter 725A of the drive control portion 725 sets the count value to the specific value (1000) in response to the setting of the start timing by the setting processing portion 723.

On the other hand, at timing t3, the $4001^{st}$ piece of pixel data is input from the second buffer 724 to the drive control portion 725. At timing t3, the setting processing portion 723 sets the start timing by notifying the drive control portion 725 of the start timing. As a result, the drive control portion 725 determines whether or not the start timing has come, based on whether or not the count value of the counter 725A is equal to or less than the value of the start timing. At timing t3, the count value of the counter 725A is 1000, and the set start timing is 500. Accordingly, the drive control portion 725 determines that the start timing has not come, and holds the $4001^{st}$ piece of pixel data for the time period that corresponds to the predetermined interval, and then outputs the pixel data to the drive portion 301 of the recording head 30. In addition, the counter 725A decrements the count value each time a piece of pixel data is input from the second buffer 724.

Next, at timing t4, the $4501^{st}$ piece of pixel data is input from the second buffer 724 to the drive control portion 725. The drive control portion 725 determines whether or not the count value of the counter 725A is equal to or less than the value of the start timing. At timing t4, the count value of the counter 725A is 500, and the set start timing is 500. As a result, the drive control portion 725 determines that the start timing has come, replaces the $4501^{st}$ piece of pixel data with specific pixel data G3, and outputs the specific pixel data G3 to the drive portion 301 of the recording head 30.

Subsequently, at timing t5, the $5001^{st}$ piece of pixel data is input from the second buffer 724 to the drive control portion 725. At timing t5, the count value of the counter 725A is 0. As a result, the drive control portion 725 holds the $5001^{st}$ piece of pixel data for the time period that corresponds to the predetermined interval, and then outputs the pixel data to the drive portion 301 of the recording head 30.

As described above, in the inkjet recording apparatus 10, in a case where the continuous print process or the single print process is executed, the non-ejection period during which the non-ejection state continues for more than the reference time period is extracted from the execution period of the print process, wherein the non-ejection state is a state in which the ink is not ejected from the nozzle 30B. Furthermore, upon extraction of the non-ejection period, the flashing is performed to stir the ink in the nozzle 30B during a partial period of the extracted non-ejection period. With this configuration, in a situation where the image quality of the print would be reduced due to increase in viscosity of the ink caused by drying of ink, the image quality of the print is prevented from being reduced even during an execution of a print process (the continuous print process or the single print process). This makes it possible to improve the image quality of the print.

In addition, the inkjet recording apparatus 10 includes the first buffer 721 and the second buffer 724 individually, wherein the second buffer 724 outputs the print data that is to be input to the recording heads 30, and the first buffer 721 outputs the same print data as the second buffer 724 before the second buffer 724 outputs the print data. In addition, the extraction process of extracting the non-ejection period is executed based on the data that is output from the first buffer 721 earlier than the second buffer 724, and the replacement process of replacing the non-ejection pixel data with the specific pixel data is executed based on the execution result of the extraction process, and the data after the replacement process is input to the recording head 30. As a result, compared to a configuration where the extraction process and the replacement process are executed on the print data stored in memory, the memory for storing the print data is not necessary. It is thus possible to reduce the capacity of memory provided in the inkjet recording apparatus 10.

It is noted that the signal processing portion 72 may include control equipment such as CPU, ROM, and RAM, and function as the extraction processing portion 722, the setting processing portion 723, and the drive control portion 725 by executing programs that are stored in advance in the ROM.

In the above-described case, the drive control portion 725 may input the second drive signal to the piezoelectric element 302 during the whole non-ejection period extracted by the extraction processing portion 722. In addition, the drive control portion 725 may input the second drive signal to the piezoelectric element 302 during a period from the start of the non-ejection period extracted by the extraction processing portion 722 or from a start timing that is set in advance, to an end timing that is set in advance. In addition, the drive control portion 725 may input the second drive signal to the piezoelectric element 302 by transmitting to the drive portion 301 a control signal that instructs inputting the second drive signal, instead of performing the process of replacing the non-ejection pixel data with the specific pixel data.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An inkjet recording apparatus comprising:

a nozzle from which ink is ejected;

a piezoelectric element provided in correspondence with the nozzle, and configured to, upon input of a predetermined first drive signal, cause the ink to be ejected from the nozzle;

an extraction processing portion configured to, when a continuous print process is executed, extract a non-ejection period during which a non-ejection state continues for more than a predetermined reference time period, from an execution period of the continuous print process based on a plurality of pieces of image data that are printed in the continuous print process, the non-ejection state being a state in which the ink is not ejected from the nozzle;

a drive control portion configured to input a predetermined second drive signal to the piezoelectric element during a partial or a whole period of the non-ejection period extracted by the extraction processing portion, the second drive signal causing the piezoelectric element to stir the ink in the nozzle and causing the piezoelectric element not to eject the ink from the nozzle;

a setting processing portion configured to set a start timing at which to start inputting the second drive signal during the non-ejection period, based on a length of the non-ejection period extracted by the extraction processing portion; and a storage portion storing table data in which a plurality of lengths of the non-ejection period are associated with a plurality of start timings, wherein the setting processing portion obtains a start timing associated with the length of the non-ejection period by consulting the table data stored in the storage portion, and sets the obtained start timing as the start timing at which to start inputting the second drive signal, and the drive control portion inputs the second drive signal to the piezoelectric element during a period from the start timing set by the setting processing portion to an end of the non-election period.

2. The inkjet recording apparatus according to claim 1, further comprising:

a plurality of the nozzles, wherein the extraction processing portion extracts the non-ejection period for each of the nozzles, and the drive control portion controls whether or not to input the second drive signal for each of the nozzles.

3. The inkjet recording apparatus according to claim 1, further comprising:

a generation processing portion configured to generate print data in which the plurality of pieces of image data printed in the continuous print process are aligned in order of printing via one or more pieces of inter-paper data that correspond to intervals between the plurality of pieces of image data, wherein the extraction processing portion extracts, as the non-ejection period, a period during which a non-ejection pixel sequence is output, wherein the non-ejection pixel sequence is composed of non-ejection pixels that continue in the print data exceeding a reference number that corresponds to the reference time period, the non-ejection pixels corresponding to non-ejection of the ink from the nozzle, the drive control portion replaces each non-ejection pixel included in the non-ejection pixel sequence that corresponds to the period from the start timing set by the setting processing portion to the end of the non-ejection period, with a specific pixel that corresponds to the second drive signal, and the inkjet recording apparatus further comprises:

a drive portion configured to drive the piezoelectric element based on the print data that has been subject to replacement performed by the drive control portion.

4. The inkjet recording apparatus according to claim 3, further comprising:

a first buffer configured to output, to the extraction processing portion, each pixel included in the print data input from the generation processing portion, in order from an upstream in the print data in a sub scanning direction at a driving interval in the drive portion; and a second buffer configured to output each pixel included in the print data input from the generation processing portion, in order from the upstream in the sub scanning direction, wherein the second buffer delays output of each pixel by a predetermined delay time compared to the first buffer, wherein the extraction processing portion counts continuous inputs of non-ejection pixels from the first buffer, and determines whether or not a continuous set of non-ejection pixels is a non-ejection pixel sequence, based on a result of counting the continuous inputs of non-ejection pixels at a time when an ejection pixel is input from the first buffer, the ejection pixel corresponding to ejection of the ink, the setting processing portion sets the start timing based on a result of counting by the extraction processing portion of the continuous inputs of non-ejection pixels in a case where the extraction processing portion determines that a continuous set of non-ejection pixels is a non-ejection pixel sequence, and the drive control portion replaces each non-ejection pixel that is input from the second buffer during a period from the start timing set by the setting processing portion until an ejection pixel is input, with the specific pixel.

5. An inkjet recording method executed in an inkjet recording apparatus that includes a nozzle from which ink is ejected, and a piezoelectric element provided in correspondence with the nozzle, and configured to, upon input of a predetermined first drive signal, cause the ink to be ejected from the nozzle, the inkjet recording method comprising:

when a continuous print process is executed, extracting a non-ejection period during which a non-ejection state continues for more than a predetermined reference time period, from an execution period of the continuous print process based on a plurality of pieces of image data that are printed in the continuous print process, the non-ejection state being a state in which the ink is not ejected from the nozzle;

inputting a predetermined second drive signal to the piezoelectric element during a partial or a whole period of the non-ejection period extracted by the extraction processing portion, the second drive signal causing the piezoelectric element to stir the ink in the nozzle and causing the piezoelectric element not to eject the ink from the nozzle; and setting a start timing at which to start inputting the second drive signal during the non-election period, based on a length of the extracted non-election period, wherein the inkjet recording apparatus further includes:

a storage portion storing table data in which a plurality of lengths of the non-ejection period are associated with a plurality of start timings, and the inkjet recording method further comprises:

obtaining a start timing associated with the length of the non-ejection period by consulting the table data stored in the storage portion, and setting the obtained start timing as the start timing at which to start inputting the second drive signal; and inputting the second drive signal to the piezoelectric element during a period from the set start timing to an end of the non-ejection period.

* * * * *